US009834877B2

(12) United States Patent
Oie

(10) Patent No.: US 9,834,877 B2
(45) Date of Patent: Dec. 5, 2017

(54) SEWING MACHINE HAVING UPPER FEED HALTING MECHANISM

(71) Applicant: JANOME SEWING MACHINE Co., LTD., Hachioji-shi, Tokyo (JP)

(72) Inventor: Takeshi Oie, Hachioji (JP)

(73) Assignee: JANOME SEWING MACHINE CO., LTD., Hachioji-Shi, Tokyo (JP)

( * ) Notice: Subject to any disclaimer, the term of this patent is extended or adjusted under 35 U.S.C. 154(b) by 2 days.

(21) Appl. No.: 15/015,000

(22) Filed: Feb. 3, 2016

(65) Prior Publication Data

US 2016/0281286 A1 Sep. 29, 2016

(30) Foreign Application Priority Data

Mar. 27, 2015 (JP) ..... 2015-067701

(51) Int. Cl.
*D05B 27/08* (2006.01)
*D05B 27/06* (2006.01)
*D05B 69/22* (2006.01)

(52) U.S. Cl.
CPC ..... *D05B 27/08* (2013.01); *D05B 27/06* (2013.01); *D05B 69/22* (2013.01)

(58) Field of Classification Search
CPC ..... D05B 27/04; D05B 27/06; D05B 27/08; D05B 69/22
See application file for complete search history.

(56) References Cited

U.S. PATENT DOCUMENTS 3,368,507 A * 2/1968 Orth ..... D05B 15/02 112/311
3,605,662 A * 9/1971 Willenbacher et al. ..... D05B 27/04 112/311
3,954,071 A * 5/1976 Mall ..... D05B 27/08 112/153
4,143,607 A * 3/1979 Hager ..... D05B 27/08 112/313

(Continued)

FOREIGN PATENT DOCUMENTS

CN 201343629 Y 11/2009
GB 2 214 665 A 9/1989

(Continued)

OTHER PUBLICATIONS

Extended European Search Report dated Jul. 29, 2016.

*Primary Examiner* — Danny Worrell
(74) *Attorney, Agent, or Firm* — McGinn IP Law Group, PLLC.

(57) ABSTRACT

A sewing machine is provided, which has lower feed teeth which feed a sewing object by a lower feed drive mechanism having a lower drive shaft 92 as a drive source and upper feed teeth which are driven by an upper feed shaft that is coupled to and driven by the lower feed drive mechanism. The sewing machine is provided with an upper feed lower shaft 1 which is supported rotatably on a machine main body and is coupled to the lower feed drive mechanism, an upper feed coupling section which transmits movement of the upper feed lower shaft to the upper feed shaft, and a transmission control section which controls halting and restarting of transmission of movement of the upper feed lower shaft. The upper feed coupling section is held at a movement transmission halt position by operation of the transmission control section.

20 Claims, 7 Drawing Sheets

PARTIAL ENLARGEMENT OF (α)

(56) References Cited

U.S. PATENT DOCUMENTS

| | | | | | |
|---|---|---|---|---|---|
| 4,612,867 | A | * | 9/1986 | Rosch | D05B 35/102 112/314 |
| 4,777,896 | A | * | 10/1988 | Nomura | D05B 27/04 112/314 |
| 4,848,254 | A | * | 7/1989 | Krowatchek | D05B 27/06 112/308 |
| 4,901,659 | A | * | 2/1990 | Nomura | D05B 27/06 112/314 |
| 4,982,677 | A | * | 1/1991 | Nomura | D05B 35/102 112/314 |
| 5,014,635 | A | | 5/1991 | Ochi et al. | |
| 5,189,969 | A | * | 3/1993 | Ito | D05B 35/102 112/306 |
| 5,222,451 | A | * | 6/1993 | Akahane | D05B 35/102 112/475.03 |

FOREIGN PATENT DOCUMENTS

| | | | |
|---|---|---|---|
| JP | H02-147091 | A | 6/1990 |
| JP | H04-215789 | A | 8/1992 |
| JP | 2001-070680 | A | 3/2001 |
| JP | 2013-052122 | A | 3/2013 |
| SU | 617501 | A1 | 7/1978 |

* cited by examiner

PARTIAL ENLARGEMENT OF (α)

VIEW ALONG Y1-Y1

VIEW ALONG X1-X1

VIEW ALONG X2-X2

Fig.3A
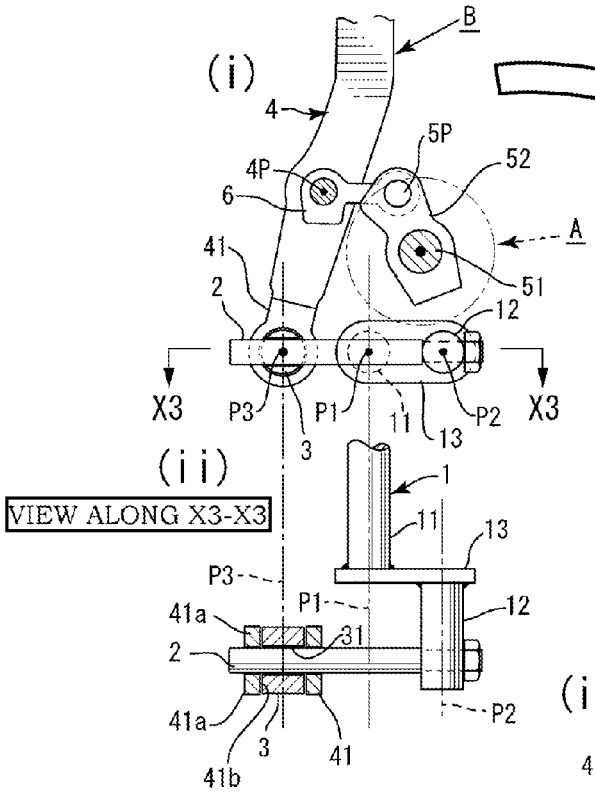
Fig.3B
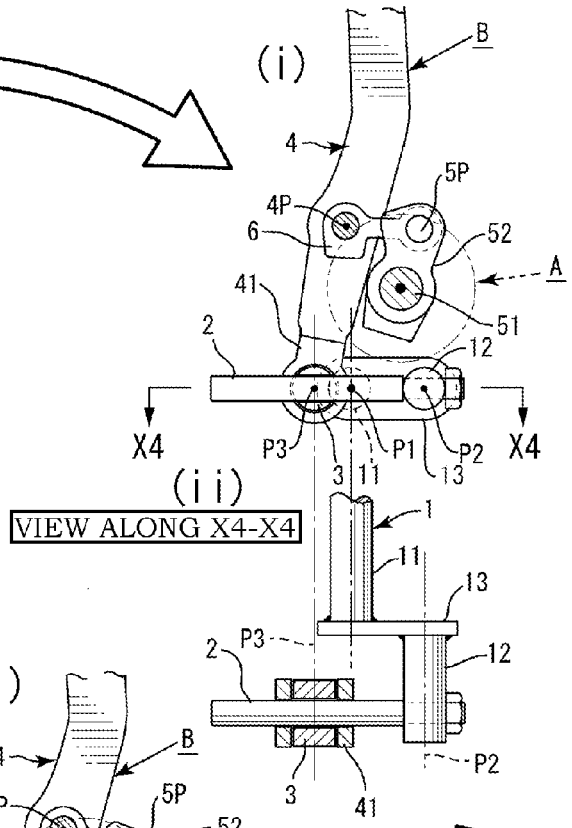
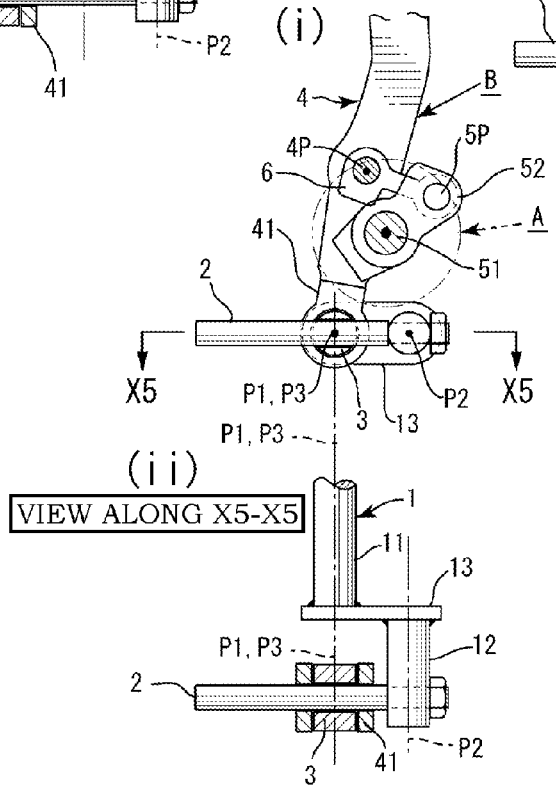
Fig.3C

PRIOR ART TECHNOLOGY

SEWING MACHINE HAVING UPPER FEED HALTING MECHANISM

BACKGROUND OF THE INVENTION

1. Field of the Invention

The present invention relates to a sewing machine having an upper feed, wherein an upper feed halting mechanism is provided to enable halting of a mechanism which drives the upper feed teeth, when the upper feed is not used.

2. Description of the Related Art

Cloth feed for feeding the cloth that is the object of sewing in accordance with a sewing action is normally performed by lower feed teeth, but upper/lower-feed sewing machines are known, in which upper feed teeth are also provided additionally and upper and lower feed is performed by supporting the sewing object from above and below.

However, the upper feed teeth may be necessary or may be unnecessary, depending on the type of the sewing object. If the upper feed teeth are not necessary, then the upper feed teeth are removed from the installation location or are withdrawn from the prescribed position. There is a drawback in that the replacement work in this case is burdensome.

There are also machines having a structure in which the upper feed teeth cannot be replaced due to the complexity involved in replacement, and there is a drawback in that only one type of feed teeth can be used, and the application thereof is limited. Furthermore, when the upper feed teeth are not used, it is necessary to withdraw the upper feed teeth to the rear of the sewing machine, and hence there are problems of safety and poorer usability, etc. Therefore, the present applicants have developed a sewing machine which simplifies the removal and replacement, etc. of the upper feed teeth. The contents thereof are shown in FIG. 7 as Japanese Patent Application Laid-open No. 2013-52122.

The contents of Japanese Patent Application Laid-open No. 2013-52122 is now described briefly. The description uses the same reference numerals for elements as those employed in Japanese Patent Application Laid-open No. 2013-52122, but the numerals are placed in parentheses in order to differentiate the elements from the description of the present invention. In the configuration of Japanese Patent Application Laid-open No. 2013-52122, a pressing bar (91), a pressing spring (92) and a needle mechanism (93) are provided in a machine main body (90), and a cloth pressing unit (α) provided with an upper feed mechanism (3) is installed on the lower end of the pressing bar (91).

An upper feed drive mechanism (β) for driving the upper feed mechanism (3) is installed on the pressing bar (91), and the upper feed mechanism (3) is driven in coupled fashion with the upper feed mechanism (3) in the coupling section (5). The upper feed mechanism (3) performs an upper feed movement by this driving, and performs an operation for feeding cloth which is the sewing object in the direction of the arrow. The cloth pressing unit (α) can be installed on and uninstalled from the pressing bar (91). The cloth pressing unit (α) is installed on the pressing bar (91) and is coupled with the upper feed drive mechanism (β) in the coupling section (5). Thereby, the upper feed mechanism (3) is driven.

SUMMARY OF THE INVENTION

Japanese Patent Application Laid-open No. 2013-52122 achieved improvements in the work of removing and replacing the upper feed teeth (30). However, even if the upper feed teeth (30) are removed from the sewing machine main body with the unit (α), the mechanism for driving the upper feed teeth (30) is not halted, but rather continues to be driven. Therefore, a problem remains in that noise and vibrations are generated during work.

Therefore, the problem to be solved by the present invention (the technical problem or object, etc.) is to eliminate excess vibration and noise of the sewing machine by halting the mechanism for driving the upper feed teeth when the upper feed teeth are not being used.

Therefore, as a result of thorough ongoing research aimed at resolving the aforementioned problem, the present inventors resolved the abovementioned problem by configuring a first embodiment of the present invention as a sewing machine having an upper feed halting mechanism, the sewing machine including lower feed teeth which feed a sewing object by a lower feed drive mechanism having a lower drive shaft as a drive source, and upper feed teeth which are driven by an upper feed shaft which is coupled to and driven by the lower feed drive mechanism, and further including: an upper feed lower shaft which is supported rotatably on a main body of the sewing machine and is coupled to the lower feed drive mechanism; an upper feed coupling section which transmits movement of the upper feed lower shaft to the upper feed shaft; and a transmission control section which controls halting and restarting of transmission of movement of the upper feed lower shaft, wherein the upper feed coupling section is held at a movement transmission halt position by operation of the transmission control section.

The present inventors resolved the abovementioned problem by configuring a second embodiment of the present invention as a sewing machine having an upper feed halting mechanism, the sewing machine including lower feed teeth which perform an operation of feeding a sewing object by a lower feed drive mechanism, and upper feed teeth which are driven by an upper feed shaft that is driven by means of an upper feed drive mechanism coupled to the lower feed drive mechanism which has a lower drive shaft as a drive source, and further including: an upper feed lower shaft which has a tip shaft section formed eccentrically by a prescribed distance with respect to the central axis of an upper feed lower shaft of the lower feed drive mechanism and which performs a rocking movement in a circumferential direction of the shaft; an upper feed lower shaft rear arm installed perpendicularly with respect to two central axes of the upper feed lower shaft in a plane formed by the two central axes; an upper feed coupling link which has a rear arm roller that is rotatably coupled to the upper feed lower shaft rear arm and performs a sliding movement on the tip shaft section of the upper feed lower shaft rear arm; and a transmission control section which moves the position of the rear arm roller of the upper feed coupling link, wherein the transmission control section causes the position of the rear arm roller to coincide with the central axis position of the main shaft section of the upper feed lower shaft.

The inventors resolved the abovementioned problem by configuring a third embodiment of the present invention as a sewing machine having an upper feed halting mechanism according to the first or second embodiment, wherein the upper feed lower shaft is configured such that the respective central axes of the main shaft section and the tip shaft section are displaced via a plate-shaped lever piece. The inventors resolved the abovementioned problem by configuring a fourth embodiment of the present invention as the sewing machine having an upper feed halting mechanism according to the first or second embodiment, wherein the main shaft section and the tip shaft section of the upper feed lower shaft are formed by bending the tip of an axle member in an L shape.

The present inventors resolve the abovementioned problem by configuring a fifth embodiment of the present invention as a sewing machine having an upper feed halting mechanism according to the second embodiment, wherein the transmission control section is provided with: an upper feed adjustment dial in which a rocking arm section is provided on one end of an adjustment shaft section and a dial is provided on the other end thereof; and an upper feed adjustment link which pivotally couples the coupling link with one end of the rocking arm section, and the adjustment shaft section and the rocking arm section perform a rocking operation in conjunction with rotation of the dial.

The present inventors resolve the abovementioned problem by configuring a sixth embodiment of the present invention as a sewing machine having an upper feed halting mechanism according to the first or second embodiment, wherein, in the transmission control section, a rocking arm section is disposed at one end of the adjustment shaft section and a stepping motor is disposed at the other end thereof, and the adjustment shaft section and the rocking arm section perform a rocking operation by operation of the stepping motor.

In the first and second embodiments of the present invention, the upper feed lower shaft is formed by a main shaft section and a tip shaft section of which the central axis is displaced in parallel with respect to the central axis of the main shaft section. An upper feed lower shaft rear arm is installed perpendicularly on the tip shaft section. A rear arm roller which can slide mutually with the tip shaft section is installed on the tip shaft section of the upper feed lower shaft rear arm. The rear arm roller is also supported rotatably on the upper feed coupling link.

The upper feed coupling link is moved by the transmission section and can cause the position of the rear arm roller to coincide with and separate from the central axis position of the main shaft section of the upper feed lower shaft. By making the central axis of the rear arm roller and the central axis of the main shaft of the upper feed lower shaft coincide with each other in the axial direction and halting the upward and downward movement of the upper feed coupling link, it is possible to halt the drive mechanism of the upper teeth to which a rocking movement is transmitted by the upper feed coupling link.

BRIEF DESCRIPTION OF THE DRAWINGS

FIGS. 3A to 3C are diagrams showing the operation of an upper feed halting mechanism;

DESCRIPTION OF THE PREFERRED EMBODIMENTS

Figure 1A:
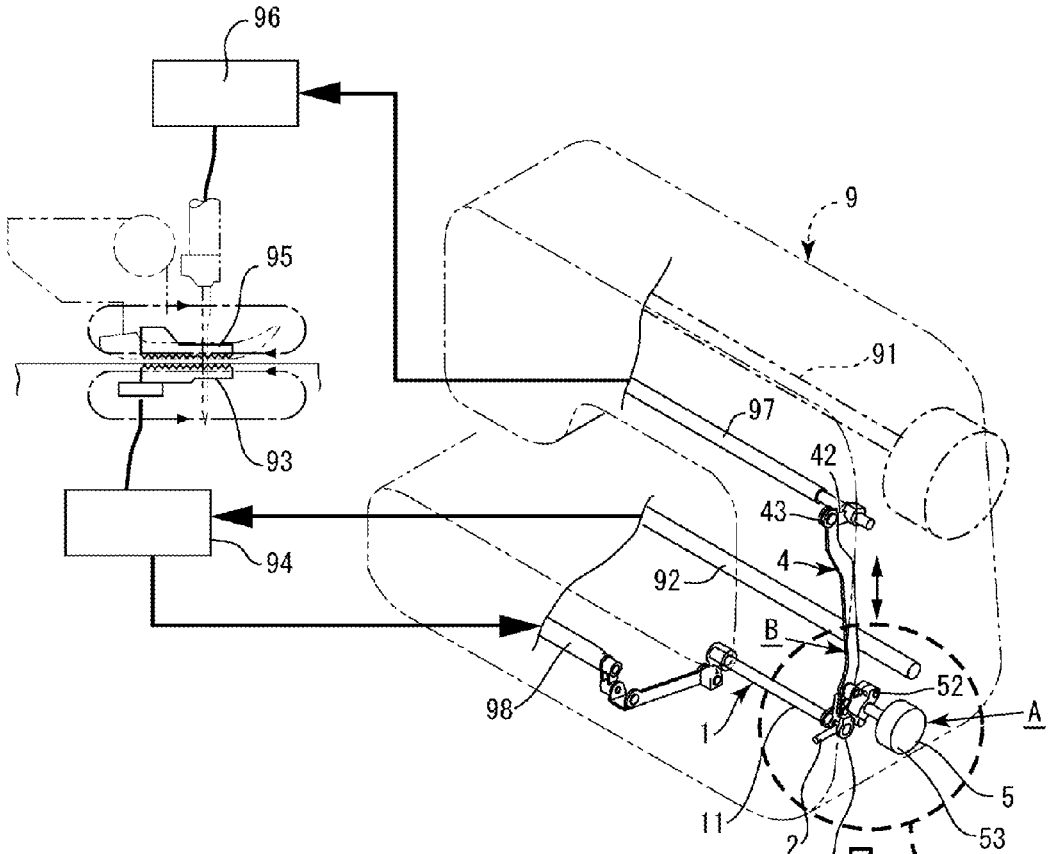
FIG. 1A is schematic perspective diagram showing the main configuration of a sewing machine provided with an upper feed halting mechanism according to the present invention.

Embodiments of the present invention are described below on the basis of the drawings. Firstly, as shown in FIG. 1, in the present invention, an upper drive shaft 91 for driving a needle bar (not illustrated) upwards and downwards, and a lower drive shaft 92 for driving a shuttle mechanism (not illustrated) and a lower feed mechanism are provided inside a machine main body 9. The upper drive shaft 91 is driven to rotate via a belt wheel, a motor and a belt (not illustrated) and causes the needle bar to move up and down.

The lower drive shaft 92 is driven to rotate via a motor (not illustrated), and drives the shuttle mechanism and the lower feed mechanism. Lower feed teeth 93 and a lower feed drive mechanism 94 which drives the lower feed teeth 93, and upper feed teeth 95 and an upper feed drive mechanism 96 which drives the upper feed teeth 95 are provided inside the machine main body 9 (see FIG. 1A).

Figure 1B:
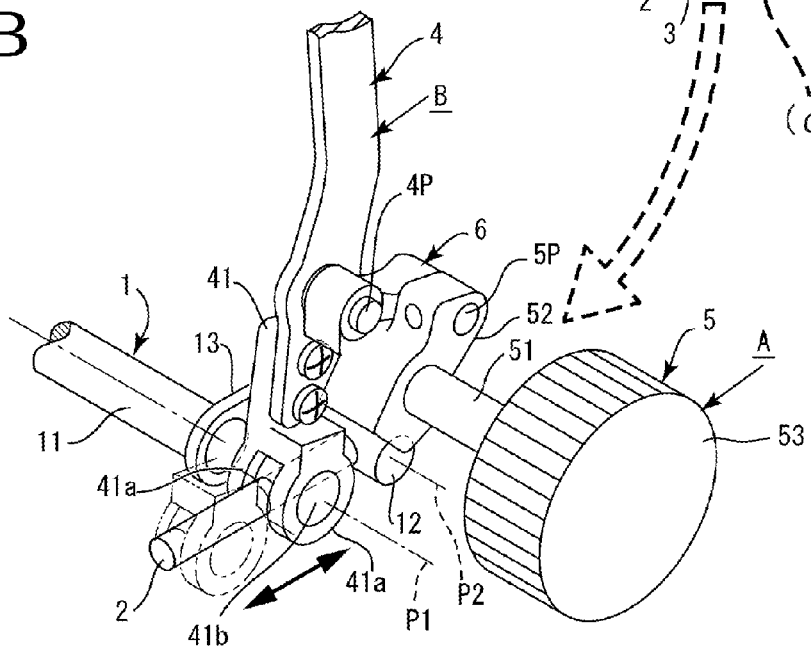
FIG. 1B is an enlarged diagram of part (α) in FIG. 1A.

The lower feed drive mechanism 94 has the lower drive shaft 92 as a drive source. The lower feed drive mechanism 94 is driven by the lower drive shaft 92, and the lower feed teeth 93 are thereby driven (see FIG. 1A). In FIG. 1A, the thick arrow linking the lower drive shaft 92 and the lower feed drive mechanism 94 indicates that the rotational action of the lower drive shaft 92 is transmitted to the lower feed drive mechanism 94. Furthermore, the thick arrow linking the lower feed drive mechanism 94 and a rocking link mechanism 98 indicates that a rotational action is transmitted from the lower feed drive mechanism 94 to the rocking link mechanism 98.

The upper feed drive mechanism 96 is coupled mechanically to the lower feed drive mechanism 94. An upper feed lower shaft 1 is coupled to the lower feed drive mechanism 94, and the upper feed lower shaft 1 is coupled mechanically to an upper feed coupling section B. An upper feed shaft 97 is coupled mechanically to the upper feed coupling section B, and the upper feed shaft 97 is coupled mechanically to the upper feed drive mechanism 96 (see FIG. 1A).

The upper feed shaft 97 transmits a rotational action to the upper feed drive mechanism 96 and operates the upper feed teeth 95. In FIG. 1A, the thick arrow linking the upper feed shaft 97 and the upper feed drive mechanism 96 indicates that the rotational action of the upper feed shaft 97 is transmitted to the upper feed drive mechanism 96. Moreover, a transmission control section A which controls the halting and restarting of the transmission of movement between the upper feed lower shaft 1 and the upper feed coupling section B is also provided (see FIG. 1).

Figure 2A:
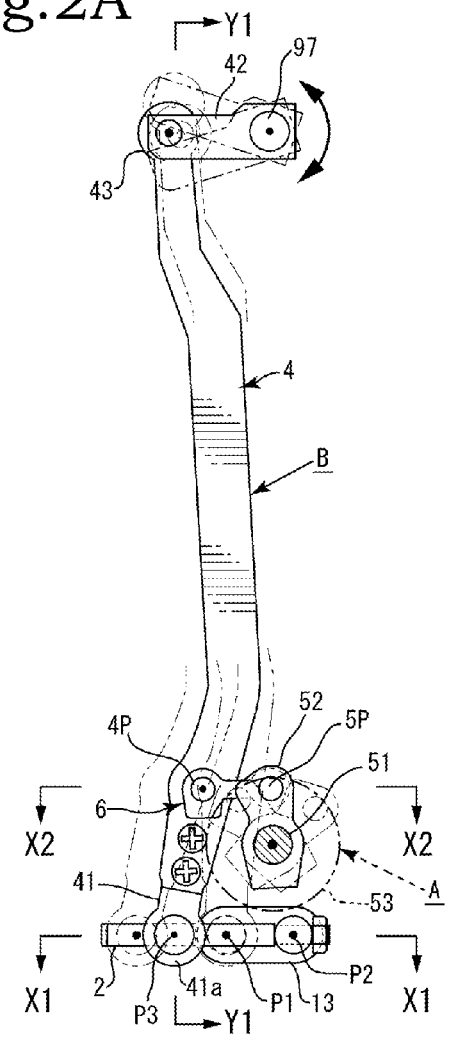
FIG. 2A is a diagram showing a configuration of the main part of an upper feed halting mechanism.

The upper feed lower shaft 1 has a main shaft section 11 and a tip shaft section 12. The central axis P1 of the main shaft section 11 and the central axis P2 of the tip shaft section 12 are mutually displaced by a prescribed distance, and the lower end portion of the upper feed coupling link 4 which is described hereinafter is configured so as to be movable (see FIG. 1B and FIG. 2C). Furthermore, the central axis P1 and the central axis P2 are parallel, and therefore the main shaft section 11 and the tip shaft section 12 are parallel (see FIG. 2C and FIG. 4). The main shaft section 11 and the tip shaft section 12 are configured in such a manner that the central axis P1 and the central axis P2 are respectively displaced by a prescribed distance via a lever piece 13 (see FIG. 2C). The lever piece 13 is formed in an oval or elliptical shape (see FIG. 2A, FIG. 4A) or a rectangular shape.

Figure 6:
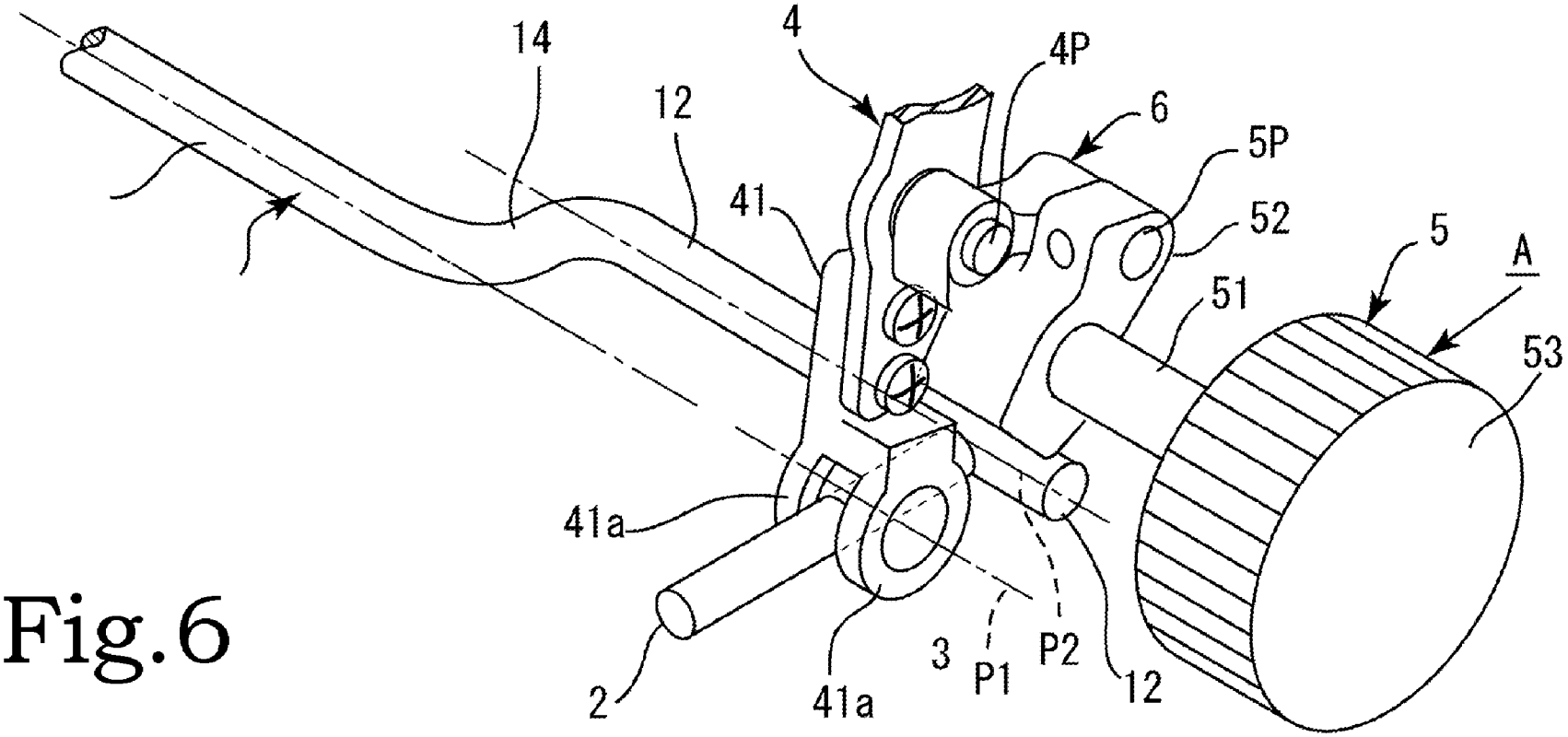
FIG. 6 is a principal perspective diagram of an embodiment of the present invention provided with an upper feed lower shaft which is curved in a L shape.
Figure 7:
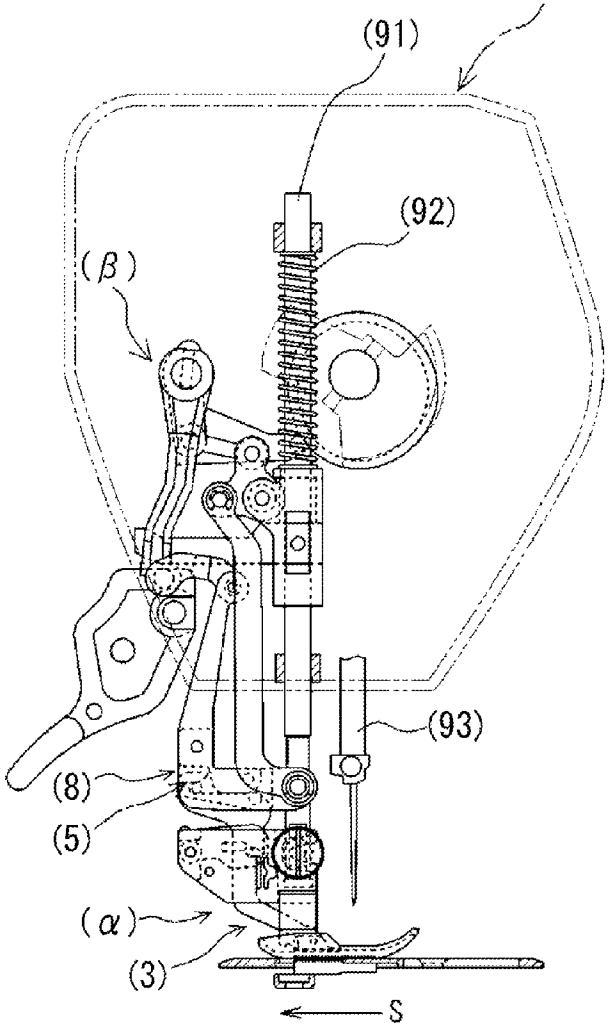
FIG. 7 is a diagram showing the main part of a mechanism according to the prior art.

Moreover, in a further embodiment of a configuration of the main shaft section 11 and the tip shaft section 12 in the upper feed lower shaft 1, the main shaft section 11 and the tip shaft section 12 in the upper feed lower shaft 1 could be formed by bending the tip of a single shaft member in an L shape, with the respective central axes P1 and P2 of the main shaft section 11 and the tip shaft section 12 of the upper feed lower shaft 1 being displaced by a prescribed amount via the bend section 14 (see FIG. 6).

The upper feed lower shaft 1 receives transmission of drive force from the lower feed drive mechanism 94 which is operated by the lower drive shaft 92 (see FIG. 1A), and the main shaft section 11 of the upper feed lower shaft 1 performs a rocking movement in a circumferential direction via a rocking link mechanism 98 which is provided on the lower feed drive mechanism 94. Due to the action of the main shaft section 11, the tip shaft section 12 performs a rocking movement about the central axis P1 of the main shaft section 11 (see FIG. 2A, FIG. 3, etc.).

Figure 2B:
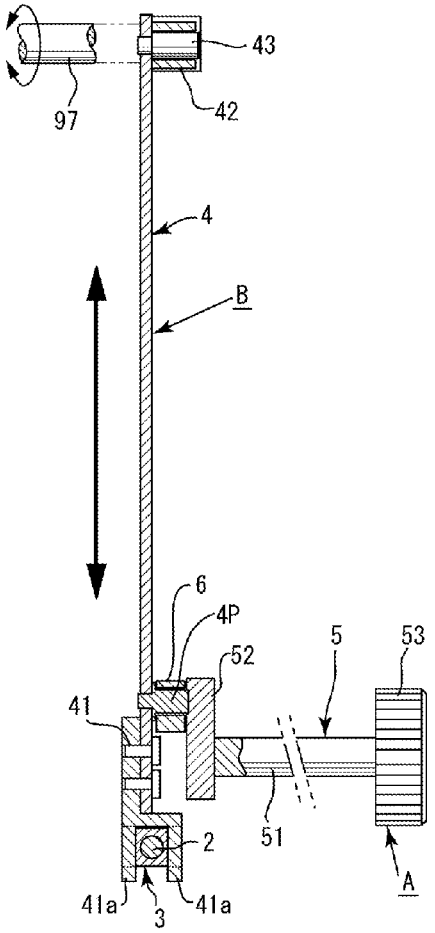
FIG. 2B is a cross-sectional diagram along arrow Y1-Y1 of FIG. 2A.
Figure 2C:
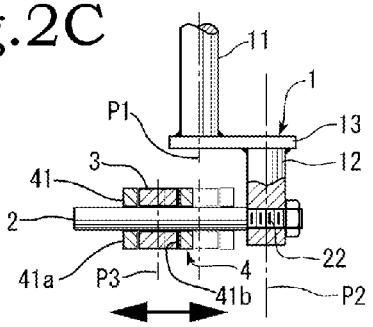
FIG. 2C is a view along arrow X1-X1 showing a partial cross-section of FIG. 2A.
Figure 2D:
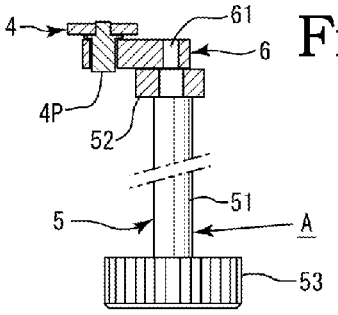
FIG. 2D is a cross-sectional diagram along arrow X2-X2 showing a partial cross-section of FIG. 2A.

An upper feed lower shaft rear arm 2 is installed in a standing fashion on the tip shaft section 12 of the upper feed lower shaft 1 (see FIG. 2C). The upper feed lower shaft rear arm 2 is axle-shaped. More specifically, a through hole is formed in the tip shaft section 12, and the axial-direction end of the axle-shaped upper feed lower shaft rear arm 2 is inserted into the through hole and fixed therein.

In a further method, the upper feed lower shaft rear arm 2 has a large diameter section 21 and a thin diameter section 22, a screw thread section is formed on the thin diameter section 22, the thin diameter section 22 is inserted into the through hole in the tip shaft section 12, a nut is fastened onto the portion of the thin diameter section 22 that protrudes from the tip shaft section 12, and the upper feed lower shaft rear arm 2 is fixed to the tip shaft section 12. Furthermore, the thin diameter section 22 may be fixed into the through hole of the tip shaft section 12 simply by pressure-fitting.

The axial direction of the upper feed lower shaft rear arm 2 is configured so as to pass perpendicularly with respect to the central axis P1 of the main shaft section 11 and the central axis P2 of the tip shaft section 12, in the plane formed by the central axes P1 and P2. A rear arm roller 3 is installed on the upper feet lower shaft rear arm 2. The rear arm roller 3 is formed as a round cylindrical short axle, and a through hole perpendicular to the axle direction is formed therein, whereby the rear arm roller 3 is installed slidably with respect to the upper feed lower shaft rear arm 2. This through hole is called a sliding hole 31.

The rear arm roller 3 is supported rotatably in the circumferential direction at a lower end location of the upper feed coupling link 4 in the upper feed coupling section B. A shaft support section 41 is provided at the lower end of the upper feed coupling link 4. In the shaft support section 41, bearing plates 41*a*, 41*a* are disposed in a two-legged fashion at a space apart (see FIG. 2B, FIG. 4).

Bearing holes 41*b*, 41*b* are formed in both bearing plates 41*a*, 41*a*, and the rear arm roller 3 of the upper feed coupling link 4 is inserted rotatably in the circumferential direction into the bearing holes 41*b*, 41*b* of the two bearing plates 41*a*, 41*a*. The sliding hole 31 in the rear arm roller 3 is set at a position between the two bearing plates 41*a*, 41*a*, and the upper feed lower shaft rear arm 2 passes through the sliding hole 31.

In this way, since the upper feed lower shaft rear arm 2 is inserted into the sliding hole 31 which is positioned between the two bearing plates 41*a*, 41*a*, then the rear arm roller 3 which is installed on the two bearing plates 41*a*, 41*a* does not become detached from the two bearing plates 41*a*, 41*a*. The shaft support section 41 is a separate member from the main body of the upper feed coupling link 4 and is connected to the upper feed coupling link 4 by fixtures, such as screws. Furthermore, the shaft support section 41 may also be formed in an integrated fashion with the upper feed coupling link 4.

One end of the connecting piece 42 in the lengthwise direction thereof is coupled pivotally via a pivot section 43, such as a protruding section, with the upper end of the upper feed coupling link 4, and the connecting piece 42 is installed in rockable fashion about the pivot section 43 at the upper end position of the upper feed coupling link 4. The upper feed shaft 97 is fixed to the other end of the connecting piece 42 in the lengthwise direction.

The upper feed shaft 97 is rotatable in the circumferential direction, but is fixed at a particular position and performs only a rotational operation in the circumferential direction. The upper feed coupling link 4 performs an operation of reciprocal movement in the up/down direction as described below, and in this case, the upper feed shaft 97 performs a rotational rocking movement in the circumferential direction via the connecting piece 42 (see FIGS. 2A, 2B, etc.).

The rear arm roller 3 slides along the axial direction of the upper feed lower shaft rear arm 2. The upper feed lower shaft rear arm 2 is disposed so as to traverse perpendicularly with respect to the line of extension of the central axis P1 of the main shaft section 11. The rear arm roller 3 moves along the upper feed lower shaft rear arm 2 and when the central axis P3 of the rear arm roller 3 coincides with the central axis P1 of the main shaft section 11, then the main shaft section 11 and the rear arm roller 3 coincide on the same axial line.

In the concentric state of this kind, the main shaft section 11 and the rear arm roller 3 both rotate on the same axial line and therefore the distance between the central axis P1 of the main shaft section 11 and the central axis P3 of the rear arm roller 3 is zero (0), and the rocking movement of the main shaft section 11 is not transmitted. As a result of this, the up/down movement of the upper feed coupling link 4 is not transmitted. In other words, in this case, the transmission of movement is halted.

Next, the transmission control section A will be described. The transmission control section A is configured principally by the operation section 5 and the upper feed adjustment link section 6 (see FIG. 1B, FIGS. 2A, B, FIG. 3, etc.). The transmission control section A, by operation of an upper feed adjustment dial 53, performs an adjustment to make the positions of the central axis P3 of the rear arm roller 3 and the central axis P1 of the main shaft section 11 of the upper feed lower shaft 1 to coincide with each other or separate from each other.

In the operation section 5, a rocking arm section 52 is installed on and fixed to one end of an adjustment shaft section 51, and the upper feed adjustment dial 53 is provided on the other end of the adjustment shaft section 51. The adjustment shaft section 51 is supported rotatably on the machine main body. One end of the upper feed adjustment link section 6 is coupled pivotally to a first pivot section 5*p*, such as a pin, which is disposed at a prescribed interval from the installation position of the adjustment shaft section 51 of the rocking arm section 52. The other end of the upper feed adjustment link section 6 is coupled pivotally to a second pivot section 4*p* which is provided on the upper feed coupling link 4 (see FIG. 1B).

By rotating the upper feed adjustment dial 53 leftwards and rightwards, the rocking arm section 52 performs a rocking movement. In conjunction with this rocking movement of the rocking arm section 52, the upper feed coupling link 4, via the upper feed adjustment link section 6, performs a rocking movement in the front/rear direction with respect to the machine main body 9 (see FIG. 2A and FIG. 3, etc.). Due to the movement of the upper feed coupling link 4 in the front/rear direction, the rear arm roller 3, which is installed rotatably on the upper feed coupling link 4, can perform a reciprocal movement in accordance with the rocking movement of the upper feed lower shaft rear arm 2.

Due to the reciprocal movement of the rear arm roller 3 in the axial direction of the upper feed lower shaft rear arm 2, the central axis P3 of the rear arm roller 3 can be made to coincide with the position of the central axis P1 of the main shaft section 11 of the upper feed lower shaft 1, or the positions of the central axis P3 and the central axis P1 can be separated. If the central axis P3 of the rear arm roller 3 does not coincide with the position of the central axis P1 of the main shaft section 11 but is separated therefrom (see FIG. 3A), then when the main shaft section 11 of the upper feed lower shaft 1 performs a rotational rocking movement, the tip shaft section 12 which is fixed to one end of the lever piece 13 that is fixed to the end portion of the main shaft section 11 performs an upward and downward rotational rocking movement about the central axis P1 of the main shaft section 11.

Moreover, the upper feed lower shaft rear arm 2 fixed to the tip shaft section 12 performs an upward and downward rotational rocking movement about the central axis P1 of the main shaft section 11. The rear arm roller 3 which is installed slidably on the tip shaft section 12 is separated from the main shaft section 11 and is at a position where the central axis P1 and the central axis P3 do not coincide, and therefore the rear arm roller 3 performs an upward and downward rotational rocking movement, the radius of the movement being the distance between the central axis P1 and the central axis P3.

The upper feed coupling link 4 which is coupled to the rear arm roller 3 performs and upward and downward reciprocal movement. Furthermore, by means of the connecting piece 42 which is coupled pivotally to the upper end of the upper feed coupling link 4, the upper feed shaft 97 performs a rotational rocking movement in the circumferential direction and this action is transmitted to the upper feed drive mechanism 96 and hence the upper feed teeth 95 operate.

There follows a description of the operation when the operating section 5 of the transmission control section A is rotated and the positions of the central axis P3 of the rear arm roller 3 and the central axis P1 of the main shaft section 11 coincide with each other. The main shaft section 11 of the upper feed lower shaft 1 performs a rotational rocking movement and the tip shaft section 12 which is fixed to one end of the lever piece 13 fixed to the end of the main shaft section 11 performs an upward and downward rotational rocking movement about the central axis P1 of the main shaft section 11. The upper feed lower shaft rear arm 2 which is fixed to the tip shaft section 12 performs an upward and downward rotational rocking movement about the central axis P1 of the main shaft section 11. Thus far, the operation is similar to that when the central axis P1 and the central axis P3 do not coincide with each other.

Thereafter, the operation is different: firstly, the central axis P3 of the rear arm roller 3 which is installed slidably on the tip shaft section 12 only rotates about the position which coincides with the position of the central axis P1 of the main shaft section 11, since the distance between the central axis P1 and the central axis P3 is zero (0). Therefore, the rear arm roller 3 only rotates in a circumferential direction at this position and does not perform an upward and downward reciprocal movement. Consequently, the upward and downward reciprocal movement of the upper feed coupling link 4 is halted, and the upper feed coupling link 4 is stationary.

Accordingly, the upper feed shaft 97 which is coupled to the upper feed coupling link 4 via the connecting piece 42 does not perform a rocking movement in the circumferential direction, and the operation of the upper feed drive mechanism 96 can be halted. In other words, when the upper feed teeth 95 are not necessary in the sewing operation of the sewing machine, then the operation of the upper feed shaft 97 and the upper feed drive mechanism 96 is halted and the application of a wasteful load during the sewing operation of the sewing machine can be avoided.

Furthermore, by adopting a configuration in which pressure is applied to the adjustment shaft section 51, then as shown in FIG. 3, it is possible to keep the position of the central axis P3 of the rear arm roller 3 at a desired position. To give a specific configuration for applying pressure to the adjustment shaft section 51, the bearing holes in the adjustment shaft section 51 are formed to a slightly small size, in such a manner that friction is applied between the adjustment shaft section 51 and the shaft holes.

Figure 4B:
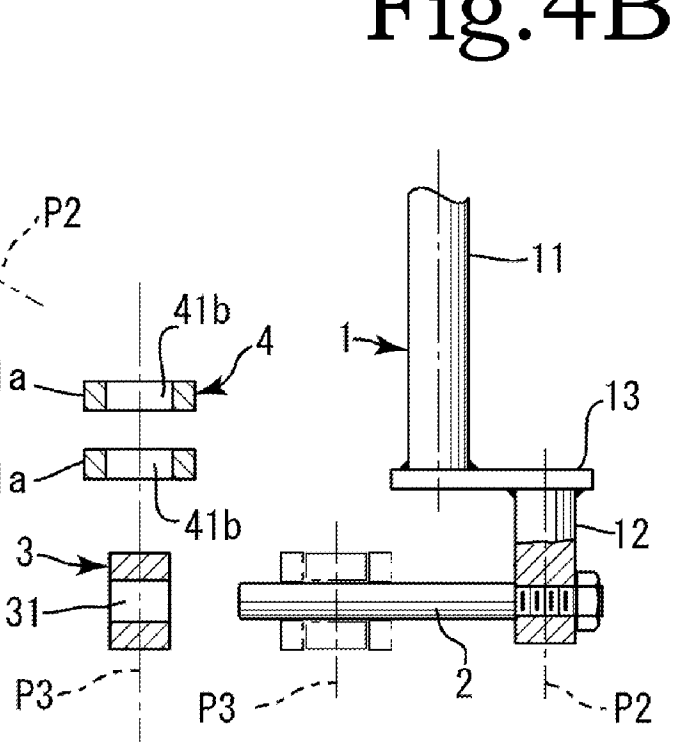
FIG. 4B is an exploded plan diagram showing a partial cross-section of the main part of the transmission control section.
Figure 4A:
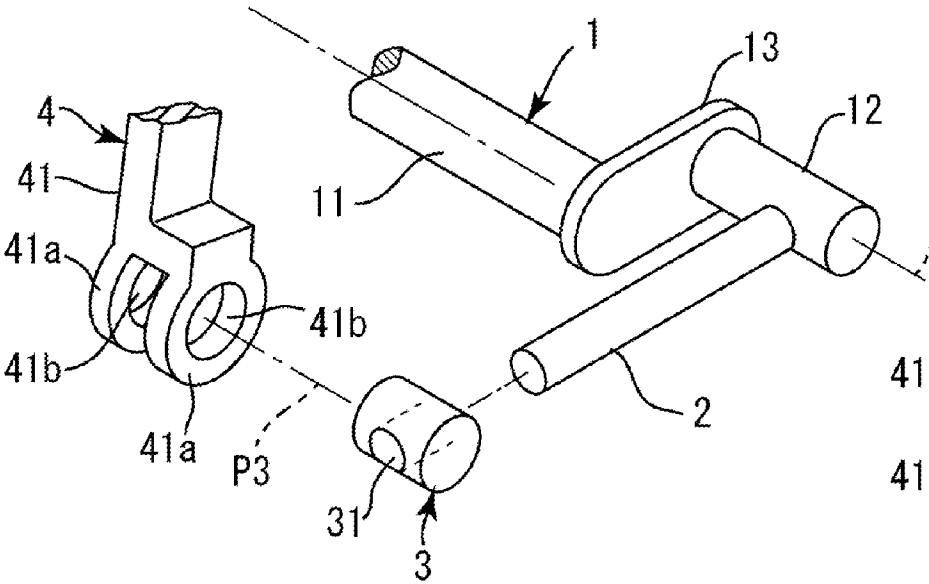
FIG. 4A is an exploded perspective diagram of the main part of a transmission control section.
Figure 5:
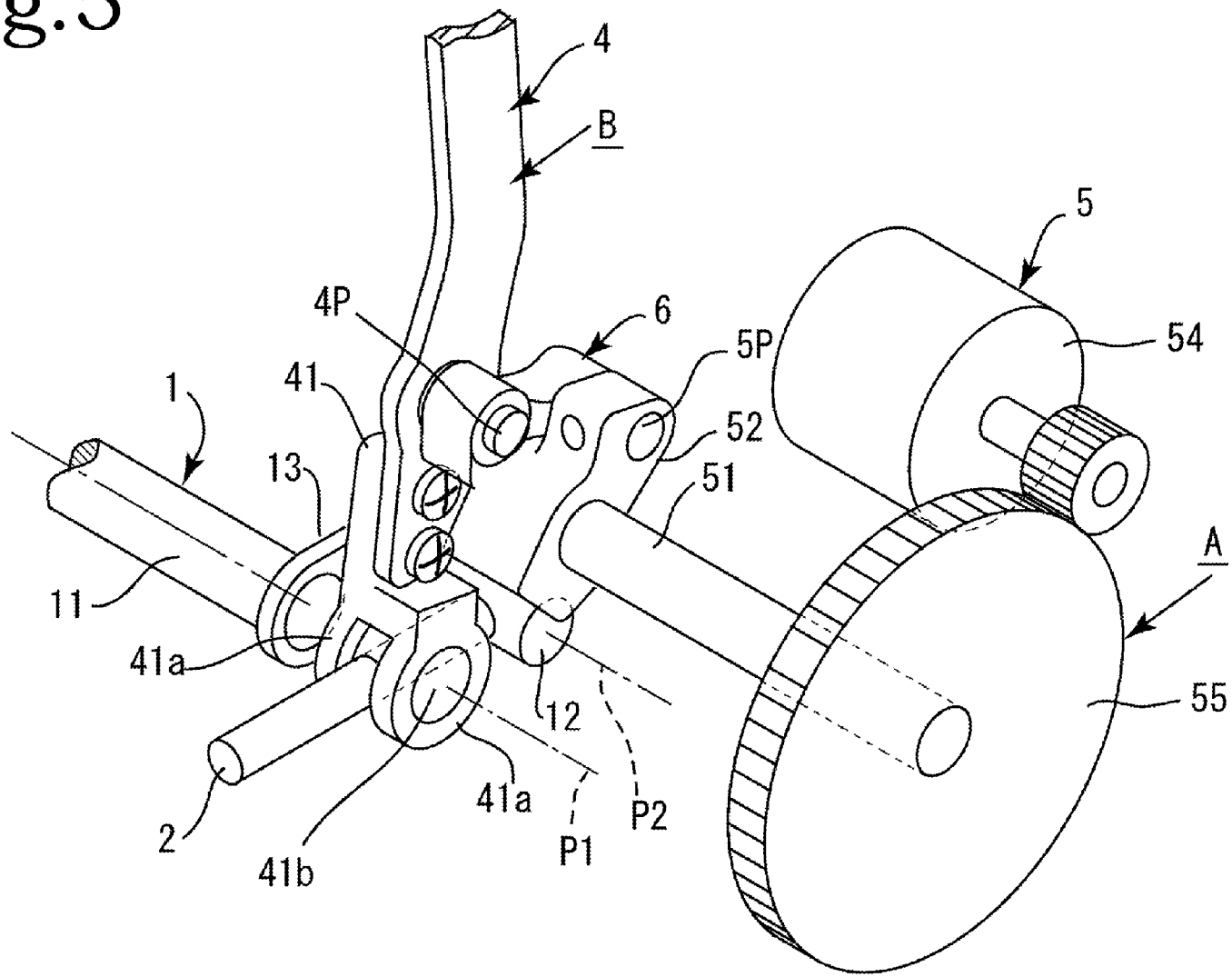
FIG. 5 is a principal perspective drawing of an embodiment of the present invention using a stepping motor as a transmission control section.

FIG. 4 shows a case where a stepping motor 54 and gear wheels 55, 56 are provided instead of the upper feed adjustment dial 53 in the operation section 5 of the transmission control section A. The adjustment shaft section 51 is rotated by the stepping motor 54. In a configuration in which a stepping motor 54 is used, it is possible to halt the upper feed mechanism when removal of the upper feed unit is detected, and if the motor is coordinated with selection of a normal pattern, then without the user being particularly aware.

In a third embodiment, by configuring the upper feed lower shaft in such a manner that the respective central axes of the main shaft section and the tip shaft section are displaced via a plate-shaped lever piece, it is possible to manufacture the structure of the upper feed lower shaft in a simple fashion. In a fourth embodiment, the main shaft section and the tip shaft section can be formed from a single shaft member. In a fifth embodiment, it is possible to configure a transmission control section of a manual type by a very simple composition. In a sixth embodiment, it is possible to configure a transmission control section which performs an extremely accurate operation, by using a stepping motor.

What is claimed is:

1. A sewing machine including an upper feed halting mechanism, the sewing machine comprising:

lower feed teeth which feed a sewing object by a lower feed drive mechanism including a lower drive shaft as a drive source, and upper feed teeth which are driven by an upper feed shaft which is coupled to and driven by the lower feed drive mechanism;

an upper feed lower shaft which is supported rotatably on a main body of the sewing machine and is coupled to the lower feed drive mechanism;

an upper feed coupling section which transmits a movement of the upper feed lower shaft to the upper feed shaft; and a transmission control section which controls halting and restarting of transmission of the movement of the upper feed lower shaft, wherein the upper feed coupling section is held at a movement transmission halt position by rotation of an operation section of the transmission control section, and wherein the transmission control section comprise a rocking arm section on one end of an adjustment shaft section and the operation section on an other end of the adjustment shaft section, a central axis of a main shaft section of the upper feed lower shaft extending parallel to a central axis of the adjustment shaft section.

2. A sewing machine including an upper feed halting mechanism, the sewing machine comprising:

lower feed teeth which perform an operation of feeding a sewing object by a lower feed drive mechanism, and upper feed teeth which are driven by an upper feed shaft which is driven by an upper feed drive mechanism coupled to the lower feed drive mechanism which includes a lower drive shaft as a drive source;

an upper feed lower shaft which includes a tip shaft section formed eccentrically by a prescribed distance with respect to a central axis of an upper feed lower shaft of the lower feed drive mechanism and which performs a rocking movement in a circumferential direction of the per feed lower shaft;

an upper feed lower shaft rear arm installed perpendicularly with respect to two central axes of the upper feed lower shaft in a plane formed by the two central axes;

an upper feed coupling link which includes a rear arm roller that is rotatably coupled to the upper feed lower shaft rear arm and performs a sliding movement on the tip shaft section of the upper feed lower shaft rear arm; and a transmission control section which moves a position of the rear arm roller of the upper feed coupling link, wherein the transmission control section causes the position of the rear arm roller to overlap with a central axis position of a main shaft section of the upper feed lower shaft.

3. The sewing machine according to claim 1, wherein the upper feed lower shaft is configured such that respective central axes of the main shaft section of the upper feed lower shaft and a tip shaft section of the upper feed lower shaft are displaced via a plate-shaped lever piece.

4. The sewing machine according to claim 1, wherein the main shaft section of the upper feed lower shaft and a tip shaft section of the upper feed lower shaft are formed by bending a tip of an axle member in an L shape.

5. The sewing machine according to claim 2, wherein the transmission control section is provided with:

an upper feed adjustment dial in which a rocking arm section is provided on one end of an adjustment shaft section and a dial is provided on an other end of the adjustment shaft section; and an upper feed adjustment link which pivotally couples the coupling link with one end of the rocking arm section, and wherein the adjustment shaft section and the rocking arm section perform a rocking operation in conjunction with a rotation of the dial.

6. The sewing machine according to claim 1, wherein, in the transmission control section, a stepping motor is disposed at the other end of the adjustment shaft section, and the adjustment shaft section and the rocking arm section perform a rocking operation by an operation of the stepping motor.

7. The sewing machine according to claim 2, wherein the upper feed lower shaft is configured such that respective central axes of the main shaft section and the tip shaft section are displaced via a plate-shaped lever piece.

8. The sewing machine according to claim 2, wherein the main shaft section and the tip shaft section of the upper feed lower shaft are formed by bending a tip of an axle member in an L shape.

9. The sewing machine according to claim 2, wherein, in the transmission control section, a rocking arm section is disposed at one end of the adjustment shaft section and a stepping motor is disposed at an other end of the adjustment shaft section, and the adjustment shaft section and the rocking arm section perform a rocking operation by an operation of the stepping motor.

10. The sewing machine according to claim 1, wherein the operation section of the transmission control section comprises a dial that rotates around the central axis of the adjustment shaft section.

11. The sewing machine according to claim 10, further comprising:

an upper feed adjustment link which pivotally couples the upper feed coupling section with the rocking arm section.

12. The sewing machine according to claim 11, wherein the adjustment shaft section and the rocking arm section perform a rocking operation in conjunction with a rotation of the dial.

13. The sewing machine according to claim 1, wherein the adjustment shaft section and the rocking arm section perform a rocking operation in conjunction with the rotation of the operation section.

14. The sewing machine according to claim 1, further comprising:

an upper feed adjustment link which pivotally couples the upper feed coupling section with the rocking arm section.

15. The sewing machine according to claim 1, wherein the upper feed lower shaft includes a tip shaft section formed eccentrically by a distance with respect to the central axis of the main shaft section of the upper feed lower shaft and performs a rocking movement in a circumferential direction of the main shaft section of the upper feed lower shaft.

16. The sewing machine according to claim 15, further comprising:

an upper feed lower shaft rear arm installed perpendicularly with respect to two central axes of the upper feed lower shaft in a plane formed by the two central axes.

17. The sewing machine according to claim 16, wherein the upper feed coupling section includes a rear arm roller that is rotatably coupled to the upper feed lower shaft rear arm and performs a sliding movement on the tip shaft section of the upper feed lower shaft rear arm.

18. The sewing machine according to claim 17, wherein the transmission control section moves a position of the rear arm roller of the upper feed coupling link.

19. The sewing machine according to claim 18, wherein the transmission control section causes the position of the rear arm roller to overlap with the central axis position of the main shaft section of the upper feed lower shaft.

20. The sewing machine according to claim 17, wherein the transmission control section causes a position of the rear arm roller to overlap with the central axis position of the main shaft section of the upper feed lower shaft.

* * * * *